US011280103B2

(12) United States Patent
Tan et al.

(10) Patent No.: US 11,280,103 B2
(45) Date of Patent: Mar. 22, 2022

(54) POWER GENERATION TYPE ELECTROMAGNETIC DAMPING TUNED MASS DAMPER

(71) Applicant: Guangzhou University, Guangzhou (CN)

(72) Inventors: Ping Tan, Guangzhou (CN); Yue Xiang, Guangzhou (CN); Hui He, Guangzhou (CN); Li Lan, Guangzhou (CN); Linfei Hao, Guangzhou (CN)

(73) Assignee: Guangzhou University, Guangdong (CN)

( * ) Notice: Subject to any disclaimer, the term of this patent is extended or adjusted under 35 U.S.C. 154(b) by 60 days.

(21) Appl. No.: 17/028,010

(22) Filed: Sep. 22, 2020

(65) Prior Publication Data

US 2021/0087842 A1 Mar. 25, 2021

(30) Foreign Application Priority Data

Sep. 23, 2019 (CN) ..... 201910898725.X

(51) Int. Cl.
*E04H 9/02* (2006.01)

(52) U.S. Cl.
CPC ..... *E04H 9/0215* (2020.05); *E04H 9/023* (2013.01)

(58) Field of Classification Search
CPC ..... E04H 9/023; E04H 9/0215; E04H 9/021; F16F 15/02; F16F 7/10; F05B 2260/964
See application file for complete search history.

(56) References Cited

U.S. PATENT DOCUMENTS 3,809,000 A * 5/1974 Horsford ..... B63B 39/02 114/124
11,136,779 B2 * 10/2021 Kim ..... E04H 9/023
2001/0048088 A1 * 12/2001 Polla ..... F16K 99/0011 251/129.06

(Continued)

OTHER PUBLICATIONS

Tang, Zuo, "Simultaneous energy harvesting and vibration control of structures with tuned mass dampers", 2012, Journal of Intelligent Material Systems and Structures, entire publication.*

(Continued)

*Primary Examiner* — Brian E Glessner
*Assistant Examiner* — Daniel J Kenny
(74) *Attorney, Agent, or Firm* — Fish & Richardson P.C.

(57) ABSTRACT

A novel power generation type electromagnetic damping tuned mass damper comprises a connecting plate, a supporting guide rail fixed to the connecting plate, an mass block, a mounting assembly fixed to the mass block and a power generation type electromagnetic damping mechanism mounted on the mounting assembly. The power generation type electromagnetic damping mechanism comprises a power generation type electromagnetic damping assembly mounted on the mounting assembly, a roller rotatably mounted on the mounting assembly, a driving wheel mounted on the roller, a driven wheel mounted at an output end of the power generation type electromagnetic damping assembly and a conveyor belt sleeved on the driving wheel and the driven wheel; the roller is mounted on the supporting guide rail in a rolling manner, and the rotating centers of the roller and the driving wheel are the same and the roller and the driving wheel rotate synchronously.

10 Claims, 3 Drawing Sheets

(56) References Cited

U.S. PATENT DOCUMENTS

2002/0166296 A1* 11/2002 Kim ..... E04H 9/023
52/167.5

OTHER PUBLICATIONS

Shen, Zhu, Xu, "Energy regenerative tuned mass dampers in high-rise buildings", published Jul. 28, 2017, https://doi.org/10.1002/stc.2072, Summary.*

* cited by examiner

POWER GENERATION TYPE ELECTROMAGNETIC DAMPING TUNED MASS DAMPER

TECHNICAL FIELD

The present invention relates to the technical field of vibration (shock) attenuation dampers for high-rise and towering structures, in particular to a novel power generation type electromagnetic damping tuned mass damper.

BACKGROUND

In recent years, with the rapid development of social economy, a large number of complex super high-rise buildings and towering structures have emerged all over the world. The high-rise and towering structure is a low-damping flexible structure. The safety and comfort performance of the structure under the action of earthquake and wind load have attracted much attention of people. Tuned Mass Damper (TMD) has relatively low cost and good control effect, and is widely used for vibration control of the high-rise and towering structure. TMD is usually formed by a mass block, a stiffness element and a damping element. It should be pointed out that the present invention focuses on the TMD damping element.

At present, the most common implementation of TMD damping elements can be roughly divided into two types: one type is a traditional velocity-dependent damper (such as an oil damper); the other type is to use friction to provide damping for the TMD. The traditional velocity-dependent damper may have an angle with the mass block during the operation of the TMD, so that the TMD damping parameters may deviate from the original design status and the TMD is unable to achieve its expected performance. A friction-type TMD has higher requirements on the material properties of the friction surface, and has more complex nonlinear behaviors, which cannot guarantee that TMD damping element will always maintain the optimal state during long-term operation.

SUMMARY

In view of the technical problems existing in the prior art, the object of the present invention is to provide a novel power generation type electromagnetic damping tuned mass damper. The novel power generation type electromagnetic damping tuned mass damper can convert the mechanical force of the roller into an electromagnetic force between a stator and a rotor of the power generation type electromagnetic damping assembly indirectly. The electromagnetic force between the stator and the rotor provides a damping force to the mass block. Therefore, the novel power generation type electromagnetic damping tuned mass damper can convert the mechanical energy of the rotor into the electric energy in the winding.

In order to achieve the above objectives, the present invention adopts the following technical solutions.

A novel power generation type electromagnetic damping tuned mass damper comprises a connecting plate, a supporting guide rail fixed to the connecting plate, an mass block, a power generation type electromagnetic damping mechanism mounted on the mass block the power generation type electromagnetic damping mechanism comprises a power generation type electromagnetic damping assembly mounted on the mounting assembly, a roller rotatably mounted on the mounting assembly, a driving wheel mounted on the roller, a driven wheel mounted at an output end of the power generation type electromagnetic damping assembly and a conveyor belt sleeved on the driving wheel and the driven wheel; the roller is mounted on the supporting guide rail in a rolling manner, and the rotating centers of the roller and the driving wheel are the same and the roller and the driving wheel rotate synchronously. In motion, when the roller rolls on the supporting guide rail, the driven wheel is driven by the driving wheel and the conveyor belt to rotate. The driven wheel transfers kinetic energy to the rotor in the power generation type electromagnetic damping assembly. The electromagnetic force between the stator and the rotor provides a damping force to the mass block. Meanwhile, the novel power generation type electromagnetic damping tuned mass damper can convert the mechanical energy of the rotor into the electric energy in the winding.

Further, the power generation type electromagnetic damping assembly comprises a power generation type electromagnetic damper and a bearing fixedly connected to the output shaft of the power generation type electromagnetic damper; the bearing is fixedly sleeved on the output shaft of the power generation type electromagnetic damper, the driven wheel is fixedly sleeved on the bearing, and the power generation type electromagnetic damper is provided with a rotor, a stator and a winding. The driven wheel drives the bearing to rotate, and the bearing drives the output shaft of the power generation type electromagnetic damper to rotate, thereby driving the rotor to rotate. When the rotor rotates, an electromagnetic force is generated between the stator and the rotor. During the movement, the mass block drives the roller to move, and the roller drives the power generation type electromagnetic damper to move through the conveyor belt, so that the mass block, the roller, and the power generation type electromagnetic damper move together.

Further, the first mounting frame comprises a fixed shaft and a first V-shaped support; both ends of the fixed shaft have a first V-shaped support, the roller and the driving wheel are rotatably mounted on the fixed shaft and located between two first V-shaped supports, the bend of the first V-shaped support is fixedly connected to the fixed shaft, both ends of the first V-shaped support are provided with a first fixed plate, and the first V-shaped support is fixedly connected to the mass block through the first fixed plate. The two first V-shaped supports make the roller bear the force of the mass block more evenly.

Further, the second mounting frame comprises a second V-shaped support and a straight tube; the bend of the second V-shaped support and one end of the straight tube are both fixedly connected to the shell of the power generation type electromagnetic damper, both ends of the second V-shaped support and the other end of the straight tube are both provided with a second fixed plate, the second V-shaped support and the straight tube are both fixedly connected to the mass block through the second fixed plate, so that the power generation type electromagnetic damper is firmly fixed to the mass block.

Further, the second mounting frame further comprises a third V-shaped support; the bend of the third V-shaped support is provided with a round tube, the end of the output shaft of the power generation type electromagnetic damper is rotatably mounted in the round tube, both ends of the third V-shaped support are provided with a third fixed plate, and the third V-shaped support is fixedly connected to the mass block through the third fixed plate, so that the output shaft of the power generation type electromagnetic damper is more stressed.

Further, the supporting guide rail is provided with a bump, the bump is provided in the rolling direction of the roller, the circumferential surface of the roller is provided with a groove, and the roller is mounted on the supporting guide rail in a rolling manner through the groove cooperating with the bump. The groove cooperates with the bump to prevent the roller from being detached.

Further, the upper surface of the supporting guide rail is an arc surface, the bump is located on the arc surface and is distributed along the arc of the arc surface, the supporting guide rail is further provided with a limit block, and the limit block is located at both ends of the arc surface. The limit block can prevent the roller from being detached from the supporting guide rail due to excessive movement of the mass block.

Further, the diameter of the driving wheel is larger than the diameter of the driven wheel. The damping force can be adjusted by adjusting the diameter of the driven wheel, and the mechanical force of the roller can be converted into electromagnetic force between the stator and the rotor as required, thereby generating suitable damping force and electric energy.

Further, there are several supporting guide rails and power generation type electromagnetic damping mechanisms, the several supporting guide rails are all fixed to the upper surface of the connecting plate, the several supporting guide rails are evenly distributed in the length and width directions of the connecting plate, and the rollers of the several power generation type electromagnetic damping mechanisms are rotatably mounted on the several supporting guide rails. The plurality of supporting guide rails and power generation type electromagnetic damping mechanisms make the damping force larger, so that the novel power generation type electromagnetic damping tuned mass damper can have a better damping effect, and the mechanical energy generated by vibration can also be converted into more electric energies.

In general, the present invention has the following advantages:

A novel power generation type electromagnetic damping tuned mass damper is provided. The novel power generation type electromagnetic damping tuned mass damper adjusts its vibration frequency by adjusting the curvature of the supporting guide rail. The vibration frequency of the novel power generation type electromagnetic damping tuned mass damper is independent of its mass , which may has a better robustness. The movement of the mass block is indirectly transmitted to the bearing of the power generation type electromagnetic damper through the conveyor belt. The bearing drives the internal rotor of the power generation type electromagnetic damper to rotate, thereby generating electromagnetic force between the stator and the rotor. The electromagnetic force between the stator and the rotor of the damper provides the damping force to the mass block. The essence of the power generation type electromagnetic damper is to convert the mechanical energy of the rotor into the electric energy in the winding. The final use of the electric energy generated in this process is not limited by the present invention. The power generation type electromagnetic damper can be integrated with the mass block without additional connection with the controlled mechanism, which has the advantages of simple structure and convenient construction. The most important thing is that the damping force of the novel power generation type electromagnetic damper directly acts on the roller, so that the damping force is strictly consistent with the movement direction of the mass block, avoiding the common problem of an included angle existing between the damper and the mass block in engineering practice, ensuring that the damping of the TMD is always in the optimal state, thereby improving the performance level of the TMD in practical engineering applications, and ensuring the safety of the TMD device under strong earthquakes or winds.

DESCRIPTION OF THE EMBODIMENTS

Figure 1:
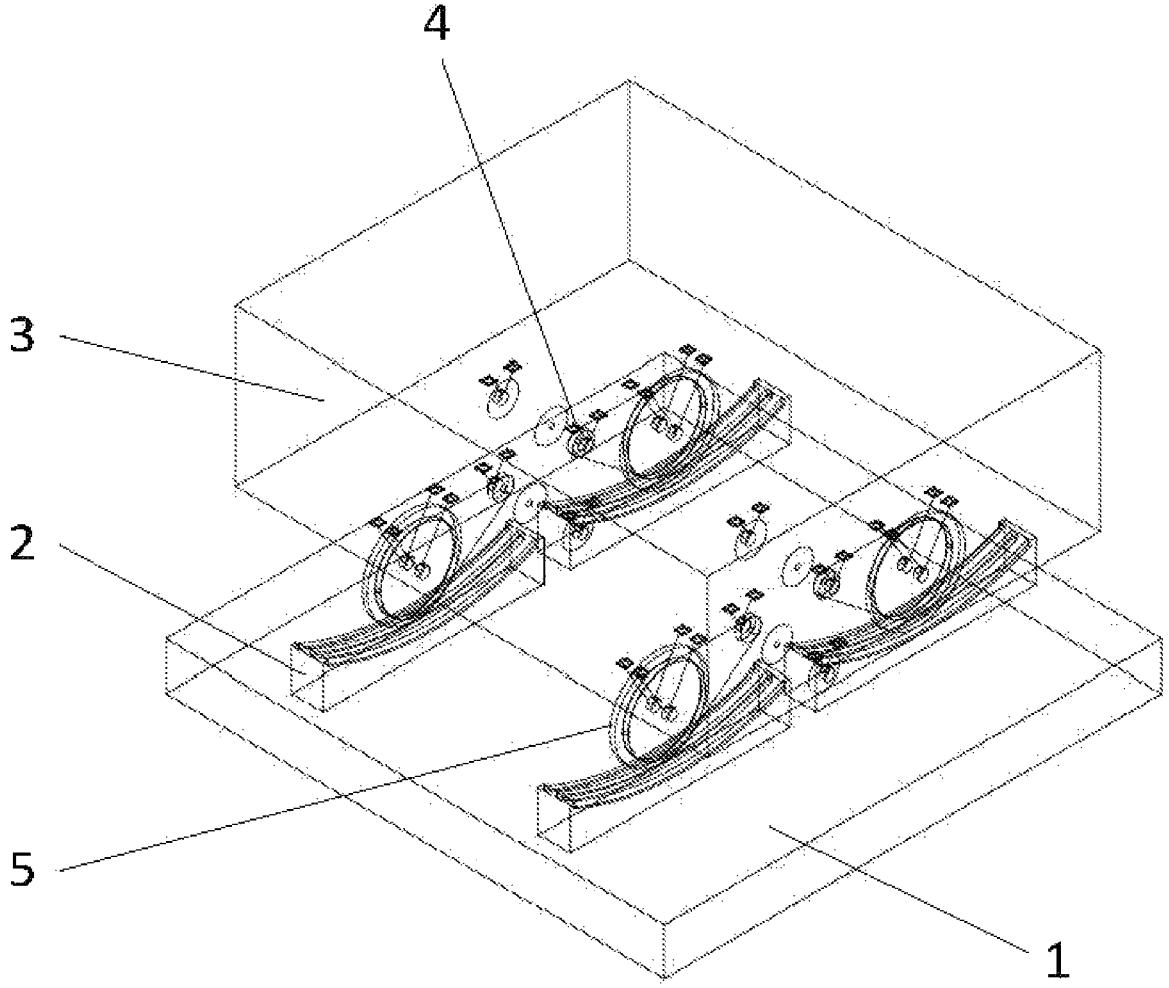
FIG. 1 is a schematic diagram of the structure of a novel power generation type electromagnetic damping tuned mass damper.

Hereinafter, the present invention will be further described in detail with reference to the drawings and specific embodiments.

In order to facilitate the unified viewing of the various reference numbers in the drawings of the specification, the reference numbers appearing in the drawings of the specification are described as follows:

1, connecting plate, 2, supporting guide rail, 3, mass block, 4, power generation type electromagnetic damping assembly, 5, roller, 6, driving wheel, 7, driven wheel, 8, conveyor belt, 9, power generation type electromagnetic damper, 10, rotor, 11, stator, 12, winding, 13, first V-shaped support, 14, straight shaft, 15, first fixed plate, 16, second V-shaped support, 17, straight tube, 18, second fixed plate, 19, third V-shaped support, 20, round tube, 21, third fixed plate, 22, shell of the power generation type electromagnetic damper, 23, output shaft of the power generation type electromagnetic damper, 24, bearing.

Figure 2:
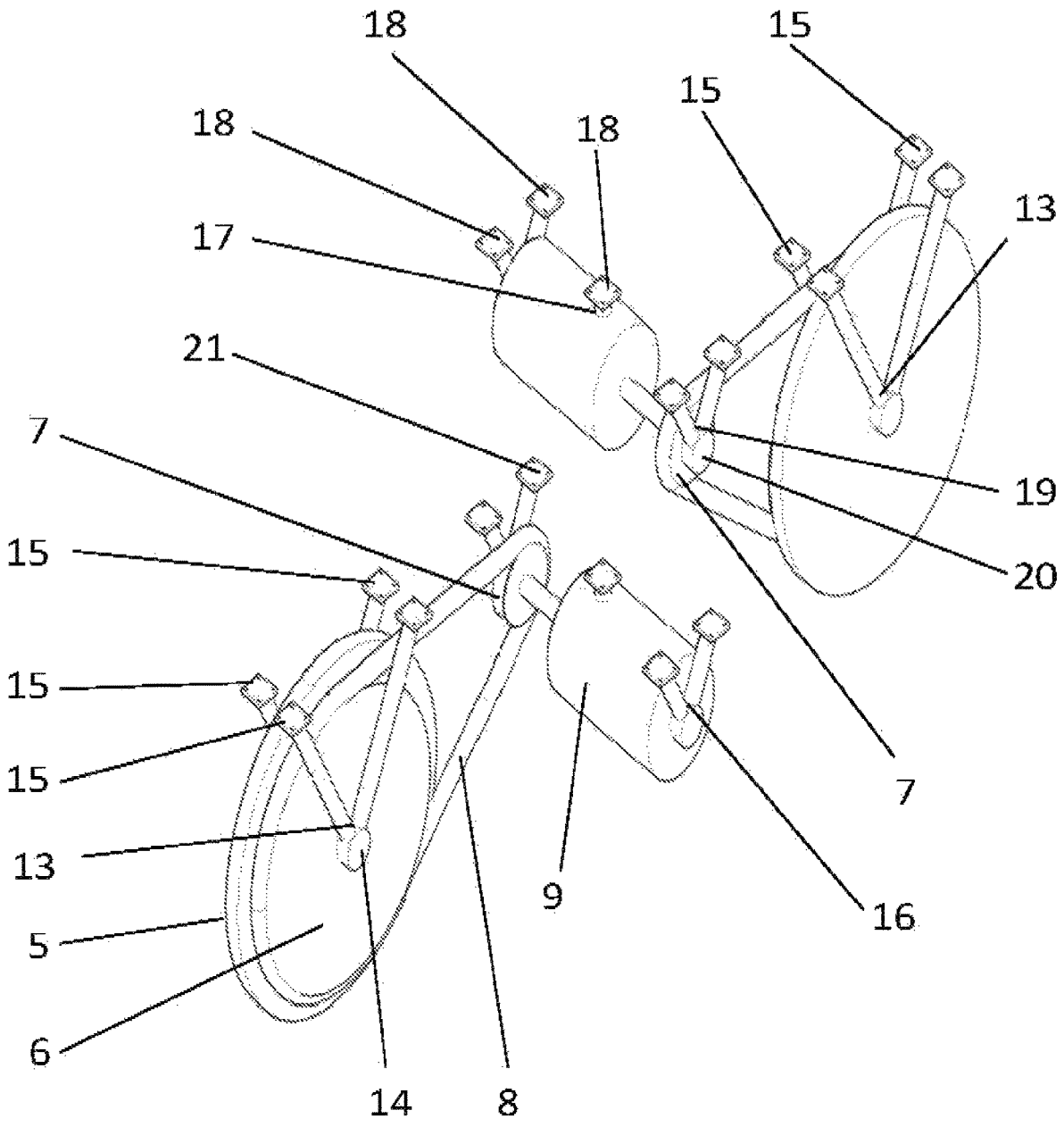
FIG. 2 is a schematic diagram of the structure of a power generation type electromagnetic damping mechanism.
Figure 3:
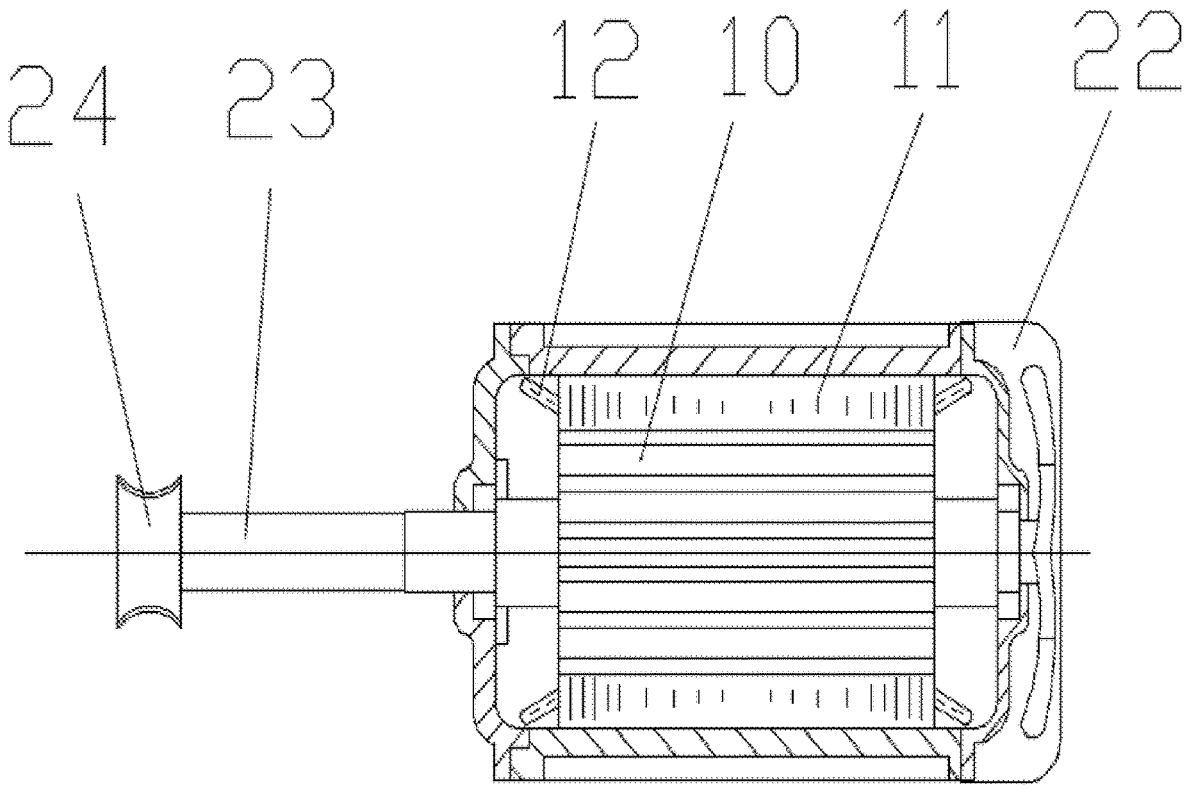
FIG. 3 is a cross-sectional diagram of a power generation type electromagnetic damper.

As shown in FIG. 1, FIG. 2, and FIG. 3, a novel power generation type electromagnetic damping tuned mass damper comprises a connecting plate, a supporting guide rail fixed to the connecting plate, an mass block, a mounting assembly fixed to the mass block and a power generation type electromagnetic damping mechanism mounted on the mounting assembly; the supporting guide rail is connected to the controlled mechanism through a connecting plate. The connecting plate is fixedly mounted on the controlled mechanism, which is a structure such as a high-rise structure. The power generation type electromagnetic damping mechanism comprises a power generation type electromagnetic damping assembly mounted on the mounting assembly, a roller rotatably mounted on the mounting assembly, a driving wheel mounted on the roller, a driven wheel mounted at an output end of the power generation type electromagnetic damping assembly and a conveyor belt sleeved on the driving wheel and the driven wheel; the mounting assembly is fixed to the lower surface of the mass block, and the roller and the power generation type electromagnetic damping assembly are both located under the mass block. The roller is mounted on the supporting guide rail in a rolling manner. The circumferential side surface of the roller is in contact with the upper surface of the supporting guide rail. The rotating centers of the roller and the driving wheel are the same and the roller and the driving wheel rotate synchronously. The rotation centers of the roller and the driving wheel are relatively fixed. The roller and the driving wheel rotate synchronously, and the angular velocity is the same. When the controlled mechanism vibrates, the mass block sways and drives the roller to roll on the supporting guide rail. The roller drives the driving wheel to rotate, and the driving wheel transmits the rotation to the driven wheel through the conveyor belt. The power generation type electromagnetic damping assembly is provided with a rotor, a stator, and a winding. The driven wheels drive the rotor of the power generation type electromagnetic damping assembly to rotate. The rotation of the rotor generates electromagnetic force between the stator and the rotor. The electromagnetic force between the stator and the rotor of the damper provides damping force to the mass block.

The power generation type electromagnetic damping assembly comprises a power generation type electromagnetic damper and a bearing fixedly connected to the output shaft of the power generation type electromagnetic damper; the bearing is fixedly sleeved on the output shaft of the power generation type electromagnetic damper, the driven wheel is fixedly sleeved on the bearing, and the power generation type electromagnetic damper is provided with a rotor, a stator and a winding. The power generation type electromagnetic damper is formed by a stator, a rotor and a winding. The rotor is made of non-magnetic materials, and permanent magnets are provided on the rotor. The stator is made of materials with higher magnetic permeability. The winding consists of conductive metal wires with insulating layers. The dimensions of the stator and the rotor of the power generation type electromagnetic damper are both preliminarily determined by the size of the mechanical energy of the mass block, and the permanent magnets and windings of the power generation type electromagnetic damper are designed according to the rated data of the damper. The mass block is in contact with the supporting guide rail through the roller. A driving wheel is provided beside the roller. The driving wheel transmits the motion of the mass block to the driven wheel through the conveyor belt, and the driven wheel transmits the motion to the bearing on the output shaft of the power generation type electromagnetic damper. The bearing drives the rotor inside the power generation type electromagnetic damper to rotate, thereby generating electromagnetic force between the stator and the rotor. The electromagnetic force between the stator and the rotor of the power generation type electromagnetic damper provides damping force to the mass block. The essence of the power generation type electromagnetic damper is to convert the mechanical energy of the rotor into an electric energy in the winding, but the final use of electric energy is not limited by the present invention.

The mounting assembly comprises a first mounting frame and a second mounting frame both fixedly mounted on the mass block; the roller is rotatably mounted on the first mounting frame, and the power generation type electromagnetic damper is mounted on the second mounting frame. Both the first mounting frame and the second mounting frame are fixedly mounted on the lower surface of the mass block. The roller and the power generation type electromagnetic damper are respectively mounted on the first mounting frame and the second mounting frame to facilitate the assembly and disassembly of the roller and the power generation type electromagnetic damper.

The first mounting frame comprises a straight shaft and a first V-shaped support; the first V-shaped support is in a bent shape, both ends of the straight shaft have a first V-shaped support, there are two first V-shaped supports, and the bends of the two first V-shaped supports are respectively fixed at both ends of the straight shaft. Both the roller and the driving wheel are rotatably mounted on the straight shaft and are located between the two first V-shaped supports, and both the roller and the driving wheel rotate around the straight shaft. The bend of the first V-shaped support is provided downwards and is fixedly connected to the straight shaft. Both ends of the first V-shaped support are provided upwards and are both provided with a first fixed plate. The first V-shaped support is fixedly connected to the mass block through the first fixed plate. The first fixed plate is provided with four threaded holes. The first fixed plate is fixed to the lower surface of the mass block by using bolts or screws to cooperate with the threaded holes. The first V-shaped support and the straight shaft are integrally formed, and the first V-shaped support and the first fixed plate are integrally formed.

The second mounting frame comprises a second V-shaped support and a straight tube; the second V-shaped support is in a bent shape, and the bend of the second V-shaped support and one end of the straight tube are both fixedly connected to the shell of the power generation type electromagnetic damper. The shell of the power generation type electromagnetic damper is cylindrical. The bend of the second V-shaped support is provided downwards and is fixedly connected to the end surface of the shell of the power generation type electromagnetic damper. One end of the straight tube is fixedly connected to the circumferential side surface of the shell of the power generation type electromagnetic damper. Both ends of the second V-shaped support and the other end of the straight tube are provided upwards and are both provided with a second fixed plate. Both the second V-shaped support and the straight tube are fixedly connected to the mass block through the second fixed plate. The second fixed plate is provided with four threaded holes. The second fixed plate is fixed to the lower surface of the mass block by using bolts or screws to cooperate with the threaded holes. The second V-shaped support and the second fixed plate are integrally formed. The rotor, the stator and the windings are all located. The rotor is fixed to the bearing, the stator is fixed to the surface of the mass block through the connector, and the winding is distributed in the shell of the power generation type electromagnetic damper in the stator.

The second mounting frame further comprises a third V-shaped support; the first V-shaped support is in a bent shape, and the bend of the third V-shaped support is provided downwards and is provided with a round tube, the end of the output shaft of the power generation type electromagnetic damper is rotatably mounted in the round tube, and the round tube provides support for the end of the output shaft of the power generation type electromagnetic damper, so that the output shaft is more stressed. Both ends of the third V-shaped support are provided upwards and both are provided with a third fixed plate. The third V-shaped support is fixedly connected to the mass block through the third fixed plate. The third fixed plate is provided with four threaded holes. The third fixed plate is fixed to the lower surface of the mass block by using bolts or screws to cooperate with the threaded holes. The third V-shaped support and the round tube are integrally formed, and the third V-shaped support and the third fixed plate are integrally formed.

The first V-shaped support, the second V-shaped support, and the third V-shaped support are all V-shaped, so that the roller and the power generation type electromagnetic damper are stressed more evenly, and so that the performance of the novel power generation type electromagnetic damping tuned mass damper is more stable.

The supporting guide rail is provided with a bump, the bump is provided in the rolling direction of the roller, the circumferential surface of the roller is provided with a groove, and the roller is mounted on the supporting guide rail in a rolling manner through the groove cooperating with the bump. The circumferential side surface of the roller is embedded on the bump, and the bump can prevent the roller from separating from the supporting guide rail in the radial direction of the roller. The contact surface of the supporting guide rail with the roller is a convex arc surface, the convex arc surface is provided in the rolling direction of the roller, the roller is a concave round wheel. The concave round wheel cooperates with the contact surface of the convex arc surface to prevent the roller from being detached.

The upper surface of the supporting guide rail is an arc surface. Along the movement direction of the roller, both ends of the upper surface of the supporting guide rail are high, and the middle of the upper surface of the supporting guide rail is low. According to the vibration frequency of the controlled mechanism, the curvature of the arc surface of the supporting guide rail is provided. Both ends of the roller are high when rolling on the supporting guide rail, so that it is not easy for the roller to be detached from the supporting guide rail. At the same time, in order to further prevent the roller from being detached from the supporting guide rail during rolling, the supporting guide rail is further provided with limit blocks. The limit blocks are located at both ends of the bump, that is, at the highest point of both ends of the supporting guide rails, so as to limit the roller from rolling outside the supporting guide rail. Anti-collision materials are provided at the inner side of the limit block.

The diameter of the driving wheel is larger than the diameter of the driven wheel. The damping force can be adjusted by adjusting the diameter of the driven wheel, and the mechanical energy of the roller can be converted into electromagnetic force between the stator and the rotor as required, thereby generating suitable damping force and electric energy.

There are several supporting guide rails and power generation type electromagnetic damping mechanisms, the several supporting guide rails are all fixed to the upper surface of the connecting plate, the several supporting guide rails are evenly distributed in the length and width directions of the connecting plate, and the rollers of the several power generation type electromagnetic damping mechanisms are rotatably mounted on the several supporting guide rails. The several supporting guide rails are in one-to-one correspondence with the several power generation type electromagnetic damping mechanisms, and a power generation type electromagnetic damping mechanism is mounted on each supporting guide rail. The number of supporting guide rails and power generation type electromagnetic damping mechanisms can be determined according to the actual situation. It is sufficient that supporting guide rails and power generation type electromagnetic damping mechanisms are evenly arranged on the upper surface of the mass block in the length or width direction, or several supporting guide rails and power generation type electromagnetic damping mechanisms are evenly arranged in both the length direction and the width direction. In this example, two supporting guide rails and two power generation type electromagnetic damping mechanisms are arranged in both the length direction and the width direction of the upper surface of the mass block to form a 2×2 array.

The working principle of the novel power generation type electromagnetic damping tuned mass damper is as follows: under the action of earthquake or wind load, the damping force of the present invention directly acts on the roller, the roller rolls back and forth on the arc surface of the supporting guide rail, the mechanical energy generated by the roller is indirectly transmitted to the power generation type electromagnetic damper, and the stator and rotor in the power generation type electromagnetic damper and the winding work together to generate damping force and electric energy, converting vibration energy into electric energy while achieving a better absorbing effect of structure. The damping force generated in this process is strictly consistent with the movement direction of the mass block, avoiding the common problem of an included angle existing between the damper and the mass block in engineering practice, ensuring that the damping of the TMD is always in the optimal state, thereby improving the performance level of the TMD in actual engineering applications. The power generation type electromagnetic damper can be integrated with the mass block. Both the power generation type electromagnetic damper and the mass block have no additional connection with the controlled mechanism, which has the advantages of simple structure and convenient construction. According to the vibration frequency of the controlled mechanism, the frequency of the TMD is determined by adjusting the curvature of the supporting guide rail, so that the frequency of the TMD is independent of its mass and has better robustness. In addition, anti-collision materials are provided inside the limit block of the supporting guide rail, ensuring the safety of the present invention under strong earthquakes or strong winds.

The above embodiments are preferred embodiments of the present invention, but the embodiments of the present invention are not limited by the above embodiments. Any other changes, modifications, substitutions, combinations, simplifications, etc. made without departing from the spirit and principle of the present invention should be equivalent replacement methods, and are all included in the protection scope of the present invention.

What is claimed is:

1. A power generation type electromagnetic damping tuned mass damper, comprising a connecting plate, a supporting guide rail fixed to the connecting plate, a mass block, a mounting assembly fixed to the mass block and a power generation type electromagnetic damping mechanism mounted on the mounting assembly; wherein the power generation type electromagnetic damping mechanism comprises a power generation type electromagnetic damping assembly mounted on the mounting assembly, a roller rotatably mounted on the mounting assembly, a driving wheel mounted on the roller, a driven wheel mounted at an output end of the power generation type electromagnetic damping assembly and a conveyor belt sleeved on the driving wheel and the driven wheel; the roller is mounted on the supporting guide rail in a rolling manner, and the rotating centers of the roller and the driving wheel are the same and the roller and the driving wheel rotate synchronously.

2. The power generation type electromagnetic damping tuned mass damper according to claim 1, wherein the power generation type electromagnetic damping assembly comprises a power generation type electromagnetic damper and a bearing fixedly connected to an output shaft of the power generation type electromagnetic damper; the bearing is fixedly sleeved on the output shaft of the power generation type electromagnetic damper, the driven wheel is fixedly sleeved on the bearing, and the power generation type electromagnetic damper is provided with a rotor, a stator and a winding.

3. The power generation type electromagnetic damping tuned mass damper according to claim 2, wherein: the mounting assembly comprises a first mounting frame and a second mounting frame both fixedly mounted on the mass block; the roller is rotatably mounted on the first mounting frame, and the power generation type electromagnetic damper is mounted on the second mounting frame.

4. The power generation type electromagnetic damping tuned mass damper according to claim 3, wherein: the first mounting frame comprises a straight shaft and a first V-shaped support; both ends of the straight shaft have a first V-shaped support, the roller and the driving wheel are rotatably mounted on the straight shaft and located between two first V-shaped supports, the bend of the first V-shaped support is fixedly connected to the straight shaft, both ends of the first V-shaped support are provided with a first fixed plate, and the first V-shaped support is fixedly connected to the mass block through the first fixed plate.

5. The power generation type electromagnetic damping tuned mass damper according to claim 4, wherein: the second mounting frame comprises a second V-shaped support and a straight tube; the bend of the second V-shaped support and one end of the straight tube are both fixedly connected to a shell of the power generation type electromagnetic damper, both ends of the second V-shaped support and the other end of the straight tube are both provided with a second fixed plate, the second V-shaped support and the straight tube are both fixedly connected to the mass block through the second fixed plate.

6. The power generation type electromagnetic damping tuned mass damper according to claim 5, wherein: the second mounting frame further comprises a third V-shaped support; the bend of the third V-shaped support is provided with a round tube, the end of the output shaft of the power generation type electromagnetic damper is rotatably mounted in the round tube, both ends of the third V-shaped support are provided with a third fixed plate, and the third V-shaped support is fixedly connected to the mass block through the third fixed plate.

7. The power generation type electromagnetic damping tuned mass damper according to claim 1, wherein: the supporting guide rail is provided with a bump, the bump is provided in the rolling direction of the roller, the circumferential surface of the roller is provided with a groove, and the roller is mounted on the supporting guide rail in a rolling manner through the groove cooperating with the bump.

8. The power generation type electromagnetic damping tuned mass damper according to claim 7, wherein: the upper surface of the supporting guide rail is an arc surface, the bump is located on the arc surface and is distributed along the arc of the arc surface, the supporting guide rail is further provided with a limit block, and the limit block is located at both ends of the arc surface.

9. The power generation type electromagnetic damping tuned mass damper according to claim 1, wherein the diameter of the driving wheel is larger than the diameter of the driven wheel.

10. The power generation type electromagnetic damping tuned mass damper according to claim 1, wherein: there are several supporting guide rails and power generation type electromagnetic damping mechanisms, the several supporting guide rails are all fixed to the upper surface of the connecting plate, the several supporting guide rails are evenly distributed in the length and width directions of the connecting plate, and the rollers of the several power generation type electromagnetic damping mechanisms are rotatably mounted on the several supporting guide rails.

* * * * *